US010024189B2

(12) United States Patent
Danescu et al.

(10) Patent No.: US 10,024,189 B2
(45) Date of Patent: Jul. 17, 2018

(54) FLOW SLEEVE FOR THERMAL CONTROL OF A DOUBLE-WALLED TURBINE SHELL AND RELATED METHOD

(71) Applicant: General Electric Company, Schenectady, NY (US)

(72) Inventors: Radu Ioan Danescu, Greer, SC (US); David Martin Johnson, Simpsonville, SC (US); Kenneth Damon Black, Greenville, SC (US); Christopher Paul Cox, Greenville, SC (US); Ozgur Bozkurt, Greenville, SC (US)

(73) Assignee: General Electric Company, Schenectady, NY (US)

( * ) Notice: Subject to any disclaimer, the term of this patent is extended or adjusted under 35 U.S.C. 154(b) by 156 days.

(21) Appl. No.: 15/236,544

(22) Filed: Aug. 15, 2016

(65) Prior Publication Data

US 2016/0348534 A1 Dec. 1, 2016

Related U.S. Application Data

(63) Continuation of application No. 13/794,136, filed on Mar. 11, 2013, now Pat. No. 9,453,429.

(51) Int. Cl.

| | |
|---|---|
| ***F01D 25/12*** | (2006.01) |
| ***F01D 25/08*** | (2006.01) |
| ***F01D 11/24*** | (2006.01) |
| ***F01D 19/02*** | (2006.01) |
| ***F01D 25/26*** | (2006.01) |

(52) U.S. Cl.

CPC ..... *F01D 25/08* (2013.01); *F01D 11/24* (2013.01); *F01D 19/02* (2013.01); *F01D 25/26* (2013.01); *F05D 2220/32* (2013.01); *F05D 2240/12* (2013.01); *F05D 2240/14* (2013.01); *F05D 2260/20* (2013.01)

(58) Field of Classification Search

CPC ..... F01D 19/02; F01D 25/08; F01D 11/24; F01D 25/26; F05D 2260/20; F05D 2220/32; F05D 2240/12; F05D 2240/14

See application file for complete search history.

(56) References Cited

U.S. PATENT DOCUMENTS

| | | | |
|---|---|---|---|
| 3,600,890 | A | 8/1971 | White et al. |
| 3,879,940 | A | 4/1975 | Stenger et al. |
| 4,522,559 | A | 6/1985 | Burge et al. |
| 4,849,895 | A | 7/1989 | Kervistin |
| 5,012,420 | A | 4/1991 | Walker et al. |

(Continued)

*Primary Examiner* — Zelalem Eshete

(74) *Attorney, Agent, or Firm* — Nixon & Vanderhye P.C.

(57) ABSTRACT

A turbine casing includes at least one shell adapted to enclose one or more turbine stages in a gas turbine engine; an air inlet in the at least one shell; a flow sleeve secured to an inside surface of the at least one shell, the flow sleeve comprising at least two arcuate segments. Each arcuate segment includes an arcuate base, a pair of sidewalls extending radially outwardly of the base thereby forming a circumferentially-extending flow channel defined by the base, the sidewalls and the inside surface. The air inlet is aligned with the flow channel and the sleeve is configured to distribute air flowing in the channel into spaces proximate the one or more turbine stages in circumferential, radial and axial directions, including along the inside surface of the at least one shell.

13 Claims, 5 Drawing Sheets

(56) References Cited

U.S. PATENT DOCUMENTS

| | | | | |
|---|---|---|---|---|
| 5,115,636 | A | 5/1992 | Zeiser | |
| 5,685,693 | A | 11/1997 | Sexton et al. | |
| 7,621,716 | B2 | 11/2009 | Regunath | |
| 7,798,767 | B2 * | 9/2010 | Kondo | F01D 21/00 415/108 |
| 8,079,804 | B2 | 12/2011 | Shteyman et al. | |
| 8,152,446 | B2 | 4/2012 | Zhang et al. | |
| 2012/0192568 | A1 | 8/2012 | Miura et al. | |

* cited by examiner

FLOW SLEEVE FOR THERMAL CONTROL OF A DOUBLE-WALLED TURBINE SHELL AND RELATED METHOD

CROSS RELATED APPLICATION

This application is a continuation of U.S. application Ser. No. 13/794,136 filed Mar. 11, 2013, and is incorporated herein by reference.

BACKGROUND OF THE INVENTION

This invention relates generally to turbine casing construction and, more particularly, to a flow sleeve mounted on the inner surface of an outer turbine shell in a double-shell turbine engine design.

In order to maximize efficiency and performance in a gas turbine engine, clearances between rotating (e.g., rotor) and stationary (e.g., stator) components should be kept to a minimum. Such clearances, however, should also accommodate expansion and contraction of the rotor and stator due to changing temperatures of the components and the changing speeds of the rotating components during the various operating conditions of the engine. For example, the rotor and stator components will radially expand as temperature increases, while the rotor components will also expand or contract with speed changes.

A variety of systems have been utilized to adjust and maintain radial and axial clearances during all conditions of turbine operation, including air distribution systems that feed cooling and heating air onto the rotor and/or stator elements. Generally, the air is taken from the air compressor of the gas turbine engine and may be distributed onto turbine blades, turbine wheels, casings, or turbine stator carrier rings. Depending upon the particular objective, air may be tapped from various stages of the compressor, or may be taken from the combustion chamber enclosure to supply the necessary heating air. The air supply systems may be provided with regulating valves so as to modulate the air flow and the temperatures by mixing air from the different sources.

Such systems have not been satisfactory in all respects, however, especially with respect to the inside surface of the outer shell or casing in a double-shell gas turbine configuration.

BRIEF SUMMARY OF THE INVENTION

In one exemplary but nonlimiting embodiment, there is provided a flow sleeve adapted for securement to an inside surface of a casing, the flow sleeve comprising: at least two arcuate segments, each arcuate segment comprising a base, a pair of sidewalls extending radially outwardly of the base thereby forming a circumferentially-extending flow channel between the sidewalls for directing air in circumferential directions; and plural flow openings in the base for directing air in a radially-inward direction.

In a second exemplary aspect, there is provided a turbine casing comprising inner and outer shells adapted to enclose one or more turbine stages in a gas turbine engine, the inner and outer shells forming a cavity radially therebetween, the outer shell provided with an air inlet to the cavity; a flow sleeve secured to an inside surface of the outer shell, within the cavity, the flow sleeve comprising at least two arcuate segments, each arcuate segment comprising a base, a pair of sidewalls extending radially outwardly of the base thereby forming a circumferentially-extending flow channel radially inward of the air inlet, the flow channel defined by the base, the sidewalls and the inside surface; the flow channel adapted to flow air in opposite circumferential and axial directions along the inside surface; and plural flow openings in the base for directing some of the air in the flow channel radially into the cavity.

In still another exemplary aspect, there is provided a turbine casing comprising at least one shell adapted to enclose one or more turbine stages in a gas turbine engine; an air inlet in the at least one shell; a flow sleeve secured to an inside surface of the at least one shell, the flow sleeve comprising at least two arcuate segments, each arcuate segment comprising a base, a pair of sidewalls extending radially outwardly of the base thereby forming a circumferentially-extending flow channel defined by the base, the sidewalls and the inside surface, the air inlet aligned with the flow channel; wherein the flow sleeve is configured to distribute air flowing in the channel into spaces proximate the one or more turbine stages in circumferential, radial and axial directions, including along the inside surface of the at least one shell.

In still another exemplary embodiment, there is provided a method of supplying cooling or heating air to a selected area in a turbomachine comprising: providing a flow sleeve on a wall of the turbomachine within the selected area; supplying air to the flow sleeve; and configuring the flow sleeve to direct the air supplied to the flow sleeve only along targeted surfaces of the selected area, within and outside of the flow sleeve.

The invention will now be described in detail in connection with the drawings identified below.

DETAILED DESCRIPTION OF THE INVENTION

Figure 1:
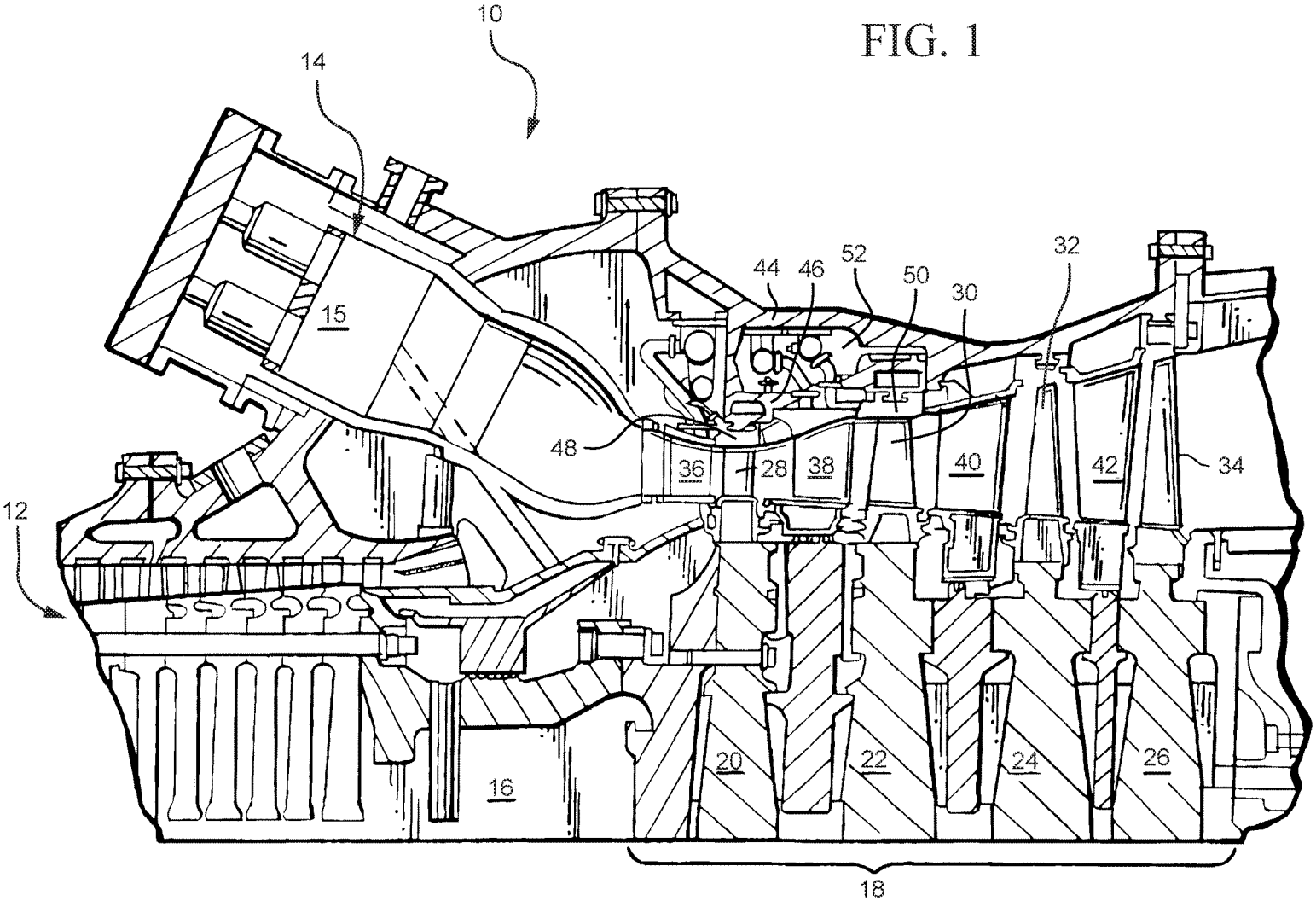
FIG. 1 is a simplified section of a known gas turbine engine configuration including an area of interest for this invention.

FIG. 1 illustrates a known gas turbine engine 10, which provides context for the exemplary embodiment with regard to the cooling of a chamber or cavity in a double-shell turbine casing. In this known configuration, air from the compressor 12 is discharged to an array of combustors in the form of "cans" 14 (one shown) located circumferentially about the rotor shaft 16. Fuel is supplied to the combustors where it mixes with air from the compressor and is burned in the combustion chamber 15. Following combustion, the resultant combustion gases are used to drive the turbine section 18, which includes in the instant example four successive stages represented by four wheels 20, 22, 24 and 26 mounted on the rotor shaft 16 for rotation therewith. Each wheel carries a row of buckets represented, respectively, by blades 28, 30, 32 and 34. The wheels are arranged alternately between fixed nozzles represented by vanes 36, 38, 40 and 42, respectively. Thus, it will be appreciated that a four-stage turbine is illustrated wherein the first stage comprises nozzles 36 and buckets 28; the second stage comprises nozzles 38 and buckets 30; the third stage comprises nozzles 40 and buckets 32; and the fourth stage comprises nozzles 42 and buckets 34.

The turbine 10 includes an outer structural containment or outer shell 44 and an inner shell 46. The inner shell 46 mounts shrouds 48, 50 surrounding the buckets in the first and second stages. The outer shell 44 is secured at axially-opposite ends to a turbine exhaust frame and at an upstream end to the compressor casing. It will be appreciated that the outer shell typically comprises a pair of arcuate half-shells joined together along horizontal joint flanges. The axial extent of the inner shell 46 may vary from one to all turbine stages, but in FIG. 1, the inner shell extends along the first and second turbine stages.

The outer and inner turbine casings or shells 44, 46 form a cavity 52 radially between the inner and outer shells, spanning approximately the first two turbine stages, but it will be appreciated that for purposes of this invention, the shape and axial extent of the cavity 52 may also vary from what is shown to include, for example, three of four stages.

Figure 2:
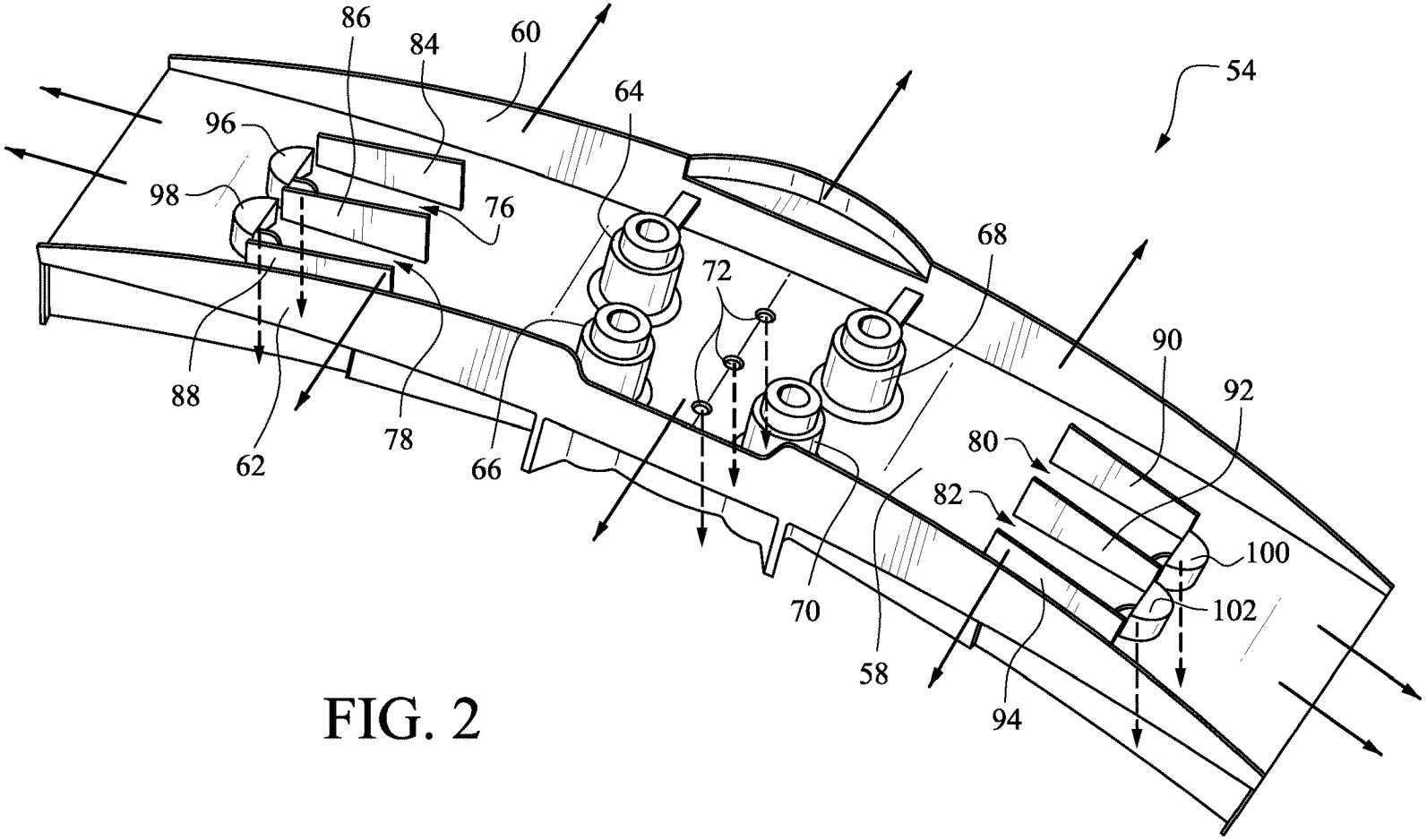
FIG. 2 is an upper perspective view of a flow sleeve segment in accordance with an exemplary but nonlimiting embodiment, and illustrating three cooling flow paths enabled by the flow sleeve segment.
Figure 3:
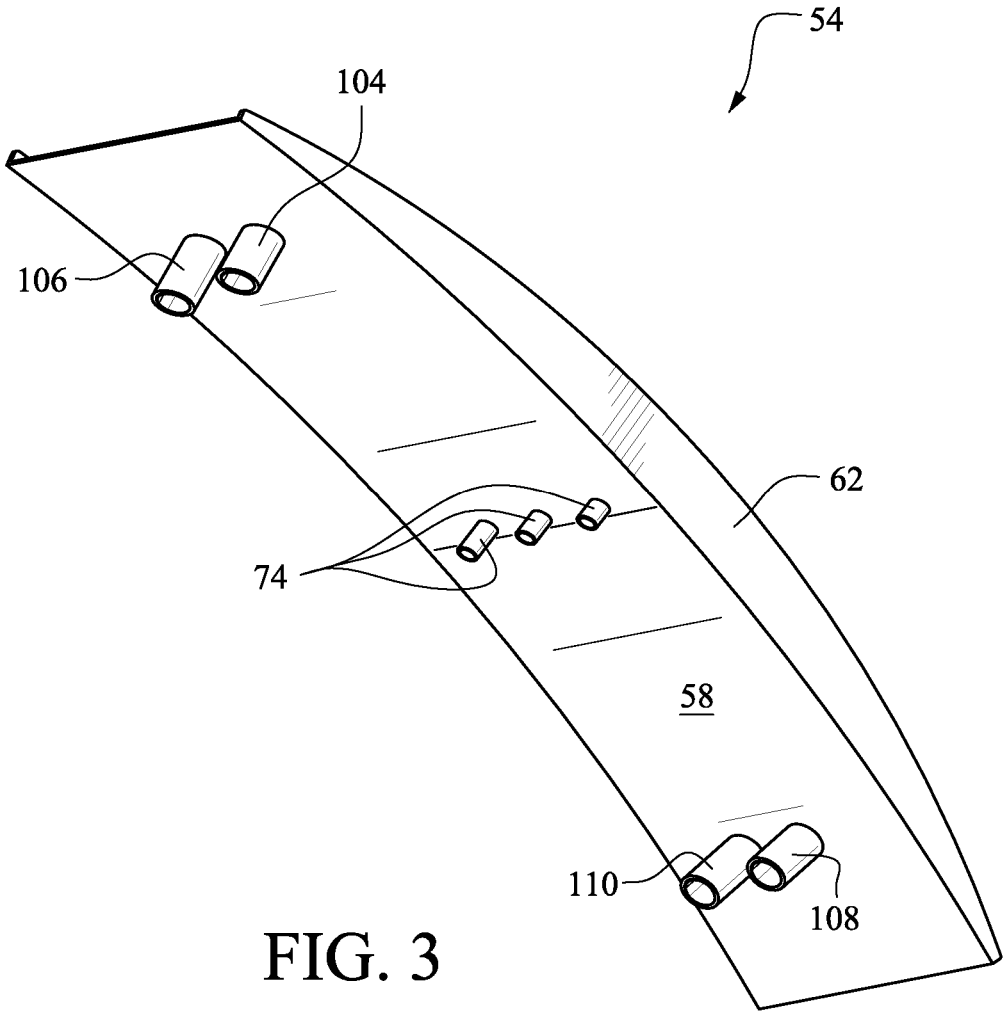
FIG. 3 is a lower perspective view of the flow sleeve segment shown in FIG. 2.

With reference now to FIGS. 2 and 3, a three-sided, relatively shallow, U-shaped flow sleeve or channel 54 is provided in the form of discrete arcuate segments that, as described further herein, extend about the interior or inner surface 56 of the outer shell 44 such that the outer shell substantially closes the open side of the flow sleeve or channel. For most applications, four flow sleeve segments 54 may be employed (for example, one per quadrant), each spanning about 45 degrees. It will be understood, however, that the number and arcuate extent of segments may vary with specific applications. In the broadest sense, the sleeves may each have an arcuate extent in the range of from >0 degrees to substantially 90 degrees, and preferably between 30 and 60 degrees, depending on specific applications. Since the flow sleeve segments are substantially identical, only one need be described in detail.

As shown in FIGS. 2 and 3, the flow sleeve segment 54 is formed to include a base 58 flanked by a pair of radially outwardly-extending side flanges or sidewalls 60, 62. The radially outer edges of sidewalls 60, 62 are curved so as to provide a gap between the outer edges of the sidewalls and the inner surface 56 of the outer shell 44. More specifically, and by way of a nonlimiting example, the gaps may be created by appropriate sizing of mounting lugs (described below) used to secure the sleeve segments to the inside surface 56 of the outer casing or shell 44.

The base 58 of the flow sleeve segment 54 is provided with four mounting lugs 64, 66, 68 and 70 that are used to secure the flow sleeve segment 54 to the outer shell 44 (with internal threads), preferably but not necessarily using an existing bolt-hole pattern on the outer shell. The number and pattern of lugs and associated bolts may vary, however, with specific applications.

Between the mounting lugs 64, 66, 68 and 70, there is an axially-aligned grouping of thrFee air jet apertures 72 that provide inlets to the jet nozzles 74 on the underside of the flow sleeve 54 (see FIG. 3). Near the opposite ends of the flow sleeve segment 54, on the radially outer side thereof, there are a pair of circumferentially-extending air passages 76, 78 and 80, 82 defined by three upstanding (radially outwardly extending) fins 84, 86, 88 and 90, 92 and 94, respectively. The fins in each group may be parallel or angled relative to each other, depending on the desired flow characteristics. At the outer end of each passage, there is a scoop or other surface feature 96, 98, 100 and 102, respectively, that catches air flowing along the base and directs that air radially inwardly via air jet nozzles 104, 106 and 108, 110 that project radially from the underside of the flow sleeve (see FIG. 3). The number, spacing and location of the jet nozzles may also vary with specific applications.

Figure 4:
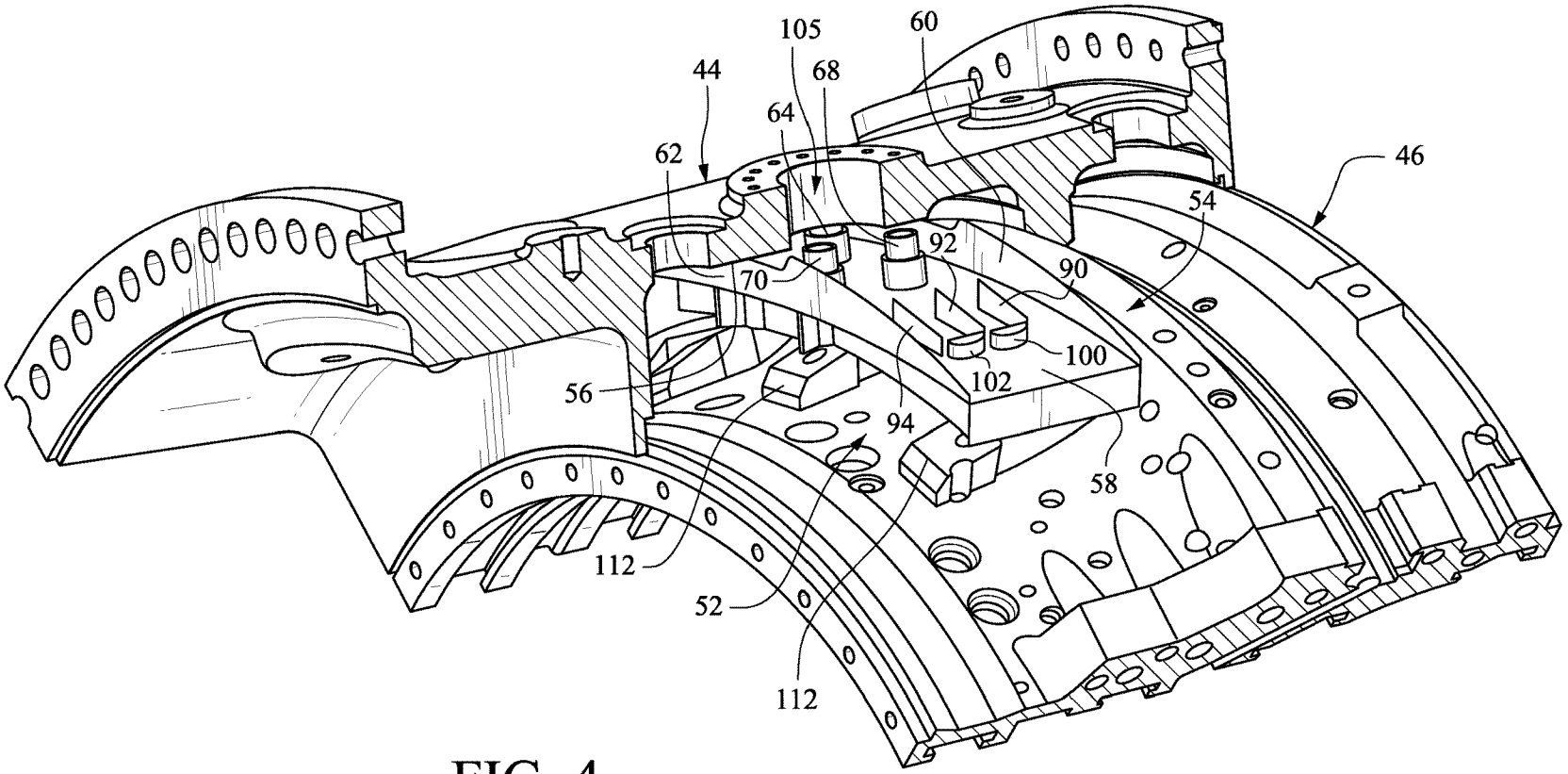
FIG. 4 is a partial perspective view of a double-shell turbine casing with the flow sleeve segment of FIGS. 2 and 3 installed.
Figure 5:
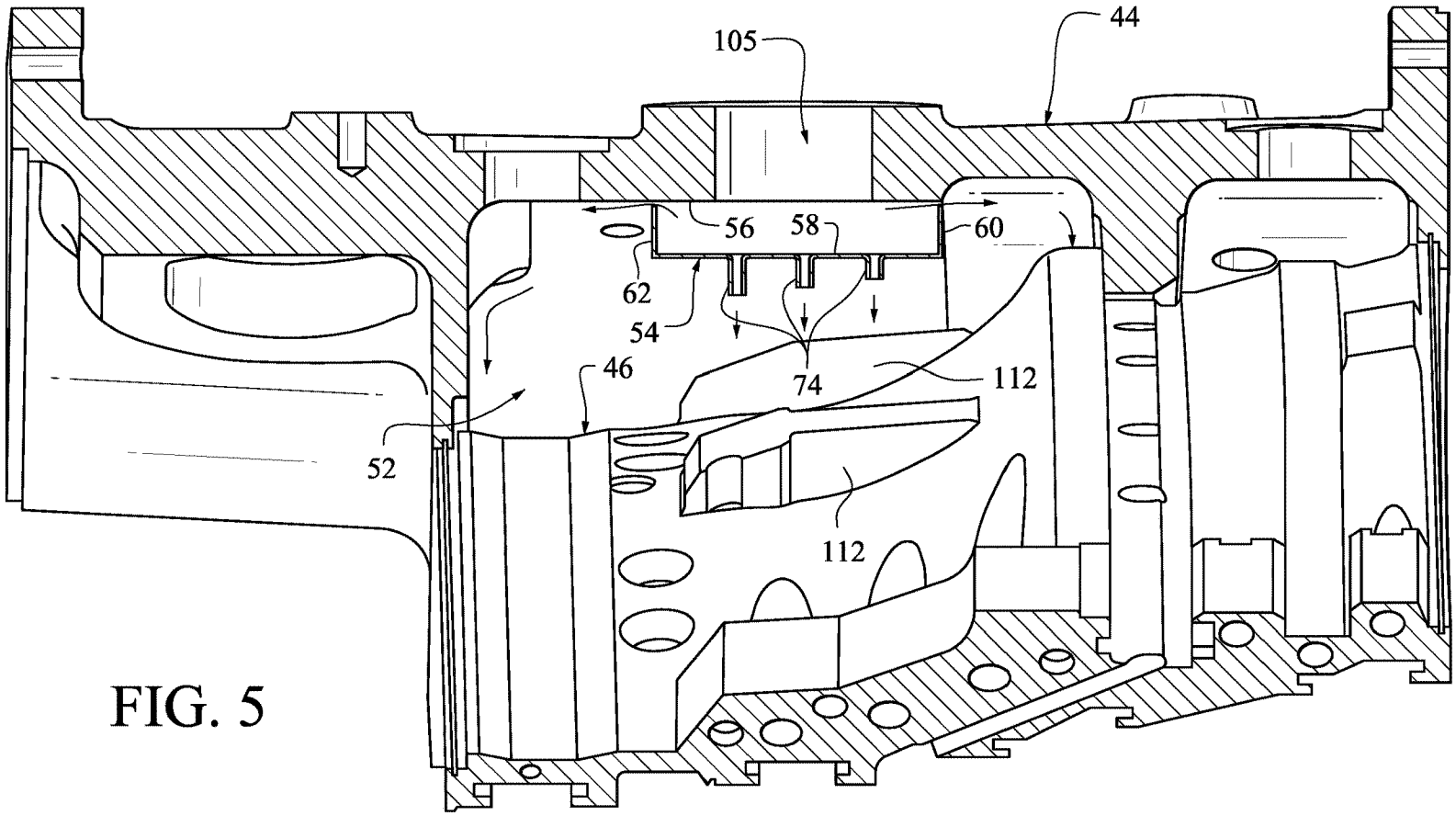
FIG. 5 is a section view of the flow sleeve installed as shown in FIG. 4 and illustrating two of three cooling flow paths enabled by the flow sleeve segment.

In the exemplary embodiment, each flow sleeve segment 54 is fastened to the interior surface 56 of the outer shell 44 within the cavity 52 as best seen in FIGS. 4 and 5. As indicated above, the cavity 52 spans at least the first and second turbine stages but the invention is not limited by the number of stages spanned by the cavity, nor to any particular width of the flow sleeve 54. In one example, the cavity 52 spans three stages, and the width of the flow sleeve 54 is approximately one-half the axial length of the cavity.

With the flow sleeve segment 54 installed as shown in FIGS. 4 and 5, various flow paths are provided by the flow sleeve in conjunction with compressor discharge air supplied to the flow sleeve via plural, compressor-discharge air inlets 105 spaced about the outer shell or casing. For example, four such inlets 105 may be provided at substantially 90-degree intervals, but this arrangement may vary. The three flow paths enabled by utilization of the flow sleeve segments 54 are shown in FIG.2 and partially shown in FIG. 5 and are described in detail below.

First, compressor discharge air will flow into each flow sleeve segment 54 via the local inlet 105 and then in opposite circumferential directions along the base 58 and along the inner surface 56 of the outer shell 44.

Second, a portion of the air will flow in opposite axial directions by reason of the gaps between the sidewalls 60, 62 and the inner surface 56 of the outer shell. This flow path extends along and about selected axial and radial surfaces that define the cavity 52, providing convection cooling to those surfaces. Significantly, these first two flow paths also serve to achieve a higher value Heat Transfer Coefficient (HTC) for the outer shell 44. By directing the air flow along the surfaces defining the cavity 52 the cooling air supplied to the cavity may be reduced since it is not necessary to fill the entire cavity with cooling air.

Third, other portions of the air flow are directed radially inwardly by the three sets of jet nozzles. Specifically, some of the air will flow into the centrally-located jet nozzles 74, and some of the air flowing along the base 58 of the flow sleeve in circumferential directions will enter the flow passages 76, 78, 80 and 82 and be captured and diverted via scoops or other surface features 96, 98, 100, 102 into pairs of radially-extending jet nozzles 104, 106 and 108, 110. Note that the fins 84, 86, 88 and 90, 92, 94 serve to align the flow of air along the passages 76, 80 and 82, 84 upstream of the jet nozzles by eliminating cross-flow components. The different radial flows through the jet nozzles in the center and at opposite ends of the flow sleeve segments are targeted to cool certain surfaces of internal configurations of the inner shell 44. For example, air exiting the jet nozzles 74, 104, 106 and 108, 110 impingement cool the axially-extending, circumferentially-spaced ribs 112 on the inner shell 46. The number and arrangement of fins and jet nozzles, and the specific targets of the radial flows may vary depending on specific applications and associated turbine shell designs.

In another exemplary embodiment, where the turbine shell or casing is of single-wall design, the flow sleeve segments 54 may be secured to the inner surface of the single shell, such that the axial and circumferential flows enhance the HTC of the shell, while the radial flows are directed generally to the stage nozzle areas generally rather than to any specific target surface feature, thus improving the control of radial clearances between the nozzles and the rotor and between the buckets and surrounding stator (i.e., the single shell). In this example, the radial apertures in the flow sleeve segment may be sufficient without the need for the extended jet nozzles.

Accordingly, the exemplary embodiment provides an efficient mechanism for supplying cooling or heating air to a cavity or selected area within a turbomachine by means of plural flow sleeve segments attached to a wall surface of the turbomachine within the cavity or selected area, supplying air to the flow sleeve, and configuring the flow sleeve to distribute the air substantially only along targeted surfaces of the cavity or selected area within and/or outside the flow sleeve.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A flow sleeve adapted for securement to an inside surface of a casing, the flow sleeve comprising:

arcuate segments each including a base, a pair of sidewalls extending radially outwardly of the base thereby forming a circumferentially-extending flow channel between the pair of sidewalls for directing air supplied to the sleeve in circumferential directions; and flow openings in the base configured to direct air in a radially inward direction, wherein each of the arcuate segments is configured to be aligned with a respective one of compressor discharge air inlets on the casing.

2. The flow sleeve of claim 1 wherein the arcuate segments each include fins extending from the base towards the inside surface of the casing, and the fins are proximate each of opposite ends of the base.

3. The flow sleeve of claim 1 wherein the arcuate segments each include fins are arranged proximate opposite ends of said base, thereby creating plural flow passages, each flow passage adapted to direct air toward at least one respective, radially-oriented aperture in said base.

4. The flow sleeve of claim 1 and further comprising at least one defined flow passage along said base, and a surface feature on said base within said flow passage for capturing and diverting air in said at least one defined flow passage into a radially-oriented aperture in said base.

5. The flow sleeve of claim 3 wherein said at least one radially-oriented aperture comprises inlets to radially-oriented jet nozzle projecting from an underside of said base.

6. The flow sleeve of claim 1 wherein said sidewalls are curved relative to the inside surface of the outer casing such that, when installed, a radial gap is formed between said sidewalls and said inside surface thereby permitting air to flow axially in opposite directions along the inside surface of the outer casing.

7. The flow sleeve of claim 1 further comprising plural radially-oriented jet nozzles in selected portions of said base.

8. A gas turbine casing comprising:

inner and outer shells adapted to enclose one or more turbine stages in a gas turbine engine;

a cavity between the inner and outer shells, wherein a radially outer wall of the cavity is formed by the outer shell and an radially inner wall of the cavity is formed by the inner shell;

a compressor discharge air inlet on the outer shell, and an arcuate segment in the cavity and including a base and sidewalls at opposite sides of the base, wherein the base includes a center section aligned with the compressor discharge air inlet along a radial line and the base has a length in a circumferential direction greater than a width in a direction of an axis of the gas turbine.

9. The gas turbine casing of claim 8 wherein the arcuate segment is one of a plurality of arcuate segments arranged in an annulus in the cavity and each arcuate segment is aligned with a respective compressor discharge air inlet.

10. The gas turbine casing of claim 8 wherein the arcuate segments each include circumferentially-extending fins proximate each of opposite ends of the base; and at least one circumferentially oriented flow passage at each of the opposite ends of the base, wherein each flow passage is between and defined by the fins at one of the opposite ends.

11. The gas turbine casing of claim 10 further comprising a scoop on the base and an aperture in the base, wherein the scoop is aligned with the flow passage along the circumferential direction and is between one of the opposite ends and the flow passage and the scoop is configured to direct air from the flow passage into the aperture.

12. The gas turbine casing of claim 11 wherein the aperture is aligned with a radially-oriented jet nozzle projecting from a side of the base opposite to a side of the base facing the outer shell.

13. The gas turbine casing of claim 8 wherein the sidewalls are curved relative to an inside surface of the outer casing, and a radial gap is formed between the sidewalls and the inside surface.

* * * * *